US005589139A

United States Patent [19]

Zinke et al.

[11] Patent Number: 5,589,139

[45] Date of Patent: Dec. 31, 1996

[54] DOWNFLOW FCC REACTION ARRANGEMENT WITH UPFLOW REGENERATION

[75] Inventors: Randy J. Zinke, Carol Stream; William J. Koves, Hoffman Estates, both of Ill.

[73] Assignee: UOP, Des Plaines, Ill.

[21] Appl. No.: 479,098

[22] Filed: Jun. 6, 1995

Related U.S. Application Data

[62] Division of Ser. No. 235,049, Apr. 29, 1994.

[51] Int. Cl.[6] ..... F27B 15/02

[52] U.S. Cl. ..... 422/144; 422/145; 422/146; 422/214; 422/219; 208/113; 208/120; 208/164

[58] Field of Search ..... 422/144, 145, 422/146, 147, 143, 214, 219; 208/113, 120, 164; 502/43, 41

[56] References Cited

U.S. PATENT DOCUMENTS

| | | | |
|---|---|---|---|
| 2,392,765 | 1/1946 | Reeves | 422/144 |
| 2,438,439 | 3/1948 | Hemminger | 422/144 |
| 2,735,822 | 2/1956 | Campbell et al. | 422/144 |
| 3,231,326 | 1/1966 | Stine et al. | 422/144 |
| 4,482,451 | 11/1984 | Kemp | 208/161 |
| 4,514,285 | 4/1985 | Niccum et al. | 208/148 |
| 4,567,022 | 1/1986 | Greenwood | 422/144 |
| 4,693,808 | 9/1987 | Dewitz | 208/113 |
| 4,797,262 | 1/1989 | Dewitz | 422/142 |
| 4,814,068 | 3/1989 | Herbst et al. | 208/155 |
| 4,859,643 | 8/1989 | Sechrist et al. | 502/37 |
| 4,880,604 | 11/1989 | Koves | 422/220 |
| 4,917,790 | 4/1990 | Owen | 208/113 |
| 4,965,232 | 12/1990 | Mauleon et al. | 208/113 |
| 4,988,430 | 1/1991 | Sechrist et al. | 208/113 |
| 5,248,408 | 9/1993 | Owen | 208/153 |
| 5,264,115 | 11/1993 | Mauleon et al. | 208/67 |
| 5,316,657 | 5/1994 | Zinke | 208/161 |
| 5,324,696 | 6/1994 | Bonifay et al. | 502/43 |
| 5,344,554 | 9/1994 | Pontier et al. | 208/164 |
| 5,424,043 | 6/1995 | Martin et al. | 422/171 |

*Primary Examiner*—Nina Bhat

*Attorney, Agent, or Firm*—Thomas K. McBride; John G. Tolomei

[57] ABSTRACT

An FCC arrangement uses two stages upflow conduit combustion and a regenerator cyclone separator to supply catalyst particles from a dip leg directly into a downflow reaction conduit. The downflow reaction conduit provides an immediate stage of initial catalyst and gas separation at its outlet end. The arrangement and method offers an improved method of operating an FCC reactor and regeneration zone without the use of large reactor or regeneration vessels. One form of the invention also uses enlarged dip pipe conduits to provide discrete zones of catalyst stripping thereby eliminating all relatively large pressure vessels from FCC method and arrangement of this invention.

7 Claims, 4 Drawing Sheets

FEED
10"
125
4
4
126
128
110
112
REGENERATION AIR
116
114
118
120
122
124
46"
102'

DOWNFLOW FCC REACTION ARRANGEMENT WITH UPFLOW REGENERATION

CROSS REFERENCE TO RELATED APPLICATION

This application is a divisional of U.S. Ser. No. 08/235,049 filed Apr. 29, 1994.

BACKGROUND OF THE INVENTION

1. FIELD OF THE INVENTION

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst. More specifically, this invention relates to the routes of catalyst transfer and feed and catalyst contacting.

2. DESCRIPTION OF THE PRIOR ART

Catalytic cracking is accomplished by contacting hydrocarbons in a reaction zone with a catalyst composed of finely divided particulate material. As the cracking reaction proceeds, substantial amounts of coke are deposited on the catalyst. A high temperature regeneration within a regeneration zone operation burns coke from the catalyst. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively.

Despite the long existence of the FCC process, techniques are continually sought for improving product recovery both in terms of product quantity and composition, i.e. yield and selectivity and for improving process operation. Improving process operation typically means the removal or simplification of equipment. Two operational functions that can improve product yield are initial feed and catalyst contacting and separation of converted feed components from catalyst. Improvement in the separation of hydrocarbons from spent catalyst and initial feed and catalyst contacting tends to benefits yield and selectivity.

It is an object of this invention to improve FCC arrangements that eliminate the large reaction and regeneration vessels.

It is a further object of this invention to improve feed and catalyst contacting and product and catalyst separation.

A yet further object of this invention is the to simplify the equipment arrangement for the stripping and separation of cracked hydrocarbons from spent catalyst.

BRIEF SUMMARY OF THE INVENTION

This invention is an FCC process arrangement that uses two stages of riser regeneration to supply catalyst to a downflow reaction conduit which supplies catalysts and vapors directly to a stage of product and spent catalyst separation. The invention uses a final stage of regeneration separation directly above a reaction conduit to provide a compact reactor and regeneration design that does not require any large reactor or regeneration vessel. The process overall operates in a highly efficient manner with a minimal inventory of catalyst and yet provides a highly controlled reaction conduit arrangement and regeneration facilities with a high degree of flexibility for controlling coke as well as CO combustion.

Where desirable this invention can provide an FCC process that operates without large dense beds of catalyst. For the purpose of this invention, a dense catalyst bed is defined as having a density of at least 20 lb/ft$^3$ and more typically a density in a range of from 30 to 40 lb/ft$^3$.

Accordingly, in one embodiment this invention is a process for the fluidized catalytic cracking of hydrocarbons. The process contacts a feedstock containing hydrocarbons with regenerated catalyst in a reaction conduit and passes a mixture of the feedstock and catalyst particles down the reaction conduit to produce a mixture of cracked hydrocarbons and spent catalyst particles containing coke. The mixture is discharged directly into a first stage of separation to at least partially separate cracked hydrocarbons from catalyst particles containing coke. The spent catalyst particles then contact a stripping gas in a stripping zone to desorb hydrocarbons from the spent catalyst particles. Hydrocarbons and stripping gas are recovered from the process while spent catalyst particles from the stripping zone enter a first regeneration conduit that transports the spent catalyst particles upwardly while contacting them with regeneration gas in a fast stage of combustion to combust coke from the spent catalyst particles. The first regeneration gas comprises at least a portion of a second regeneration gas from a second stage of combustion. Spent catalyst particles in the first regeneration gas are separated in a first regeneration separation zone. The spent catalyst particles from the fast regenerator separation zone pass through a second regeneration riser wherein a second regeneration gas transports the spent catalyst particles upward to combust additional coke from the spent catalyst particles and produce regenerated catalyst particles. A second regenerator separation zone separates the regenerated catalyst particles from the second regeneration gas and the regeneration catalyst particles pass downwardly from the second regeneration separation zone to supply catalyst to the reaction conduit for contacting the feedstock. At least a portion of the second regeneration gas passes into admixture with the first regeneration gas.

In a more specific embodiment of the invention a fluidized catalytic cracking arrangement contacts a feedstock containing hydrocarbons with regenerated catalyst particles at the top of a reaction conduit and passes the mixture of the feedstock and particles down the reaction conduit to produce a mixture of cracked hydrocarbons and spent catalyst particles that are discharged from the end of the conduit directly into a first reactor cyclone separator which at least partially separates cracked hydrocarbons from the catalyst. A bottom dip-leg conduit of the first reactor cyclone contacts the spent catalyst particles with a stripping gas to desorb hydrocarbons. The cracked hydrocarbons pass from the fast cyclone through conduit that passes the cracked hydrocarbons into a second reactor cyclone separator to recover cracked hydrocarbons from the process. The conduit between the cyclone separators may be used as a quench conduit for contacting the cracked hydrocarbons immediately with a quench medium cracked hydrocarbons may be contacted with a quench medium downstream of the second cyclone separator. Spent catalyst particles from the first and second reactor cyclone separators enter the bottom of a first regenerator conduit wherein a first regeneration gas transports the spent catalyst particles upwardly in a first stage of combustion to combust coke from the spent catalyst particles. At least a portion of the first regeneration gas comprises regeneration gas from a second stage of combustion. The spent catalyst and the first regeneration gas are separated in a first regenerator cyclone and catalyst particles from the first regenerator cyclone pass to a second regenerator conduit that transports the spent catalyst particles upwardly through a second stage of combustion. The second stage of combustion removes additional coke from the spent catalyst particles and produces regenerated catalyst particles. Regenerated catalyst particles and the second regeneration gas pass to a second regenerator cyclone located super-adjacent to the top of the reactor conduit. The second regenerator conduit separates regenerated catalyst from the second regeneration gas and passes the regenerated catalyst downwardly from a dip-pipe conduit into the reaction conduit and contact with the feedstock. At least a portion of the second regeneration gas from the second regenerator cyclone passes into admixture with the first regeneration gas.

In an apparatus embodiment, this invention includes a vertical reaction conduit, first and second regenerator conduits and a primary dip-pipe conduit located above the vertical reaction conduit. The vertical reaction conduit has an upper inlet for receiving catalyst particles from the primary dip-pipe conduit. A separator is in direct communication with the lower end of the reaction conduit for separating gas from spent catalyst particles. Means are provided for contacting the spent catalyst particles from the reaction conduit with a stripping gas. A catalyst collector communicates the spent catalyst from the collector to a spent catalyst conduit. The first regenerator conduit is in communication with the spent catalyst conduit and a fast regeneration gas conduit to supply a fast regeneration gas and to transfer spent catalyst particles from the lower end to the upper end of the fast regenerator conduit. A first regenerator cyclone communicates with the upper end of the fast regenerator conduit to separate the first regeneration gas from the catalyst particles. A second regenerator conduit has a lower end in communication with the first regenerator cyclone for receiving catalyst particles therefrom and has means for contacting the catalyst particles with a second regeneration gas to transport the catalyst particles upwardly therein. A second regenerator cyclone located above the reaction conduit has an inlet in communication with the upper end of the second regenerator conduit, a gas outlet communicating with the first regeneration gas conduit and the primary dip-pipe conduit directly located therebelow in direct communication with the reaction conduit for transferring regenerated catalyst particles to the inlet of the reaction conduit.

Additional objects, details, and embodiments of this invention are disclosed in the following detailed description of the invention.

DETAILED DESCRIPTION OF THE INVENTION

Figure 1:
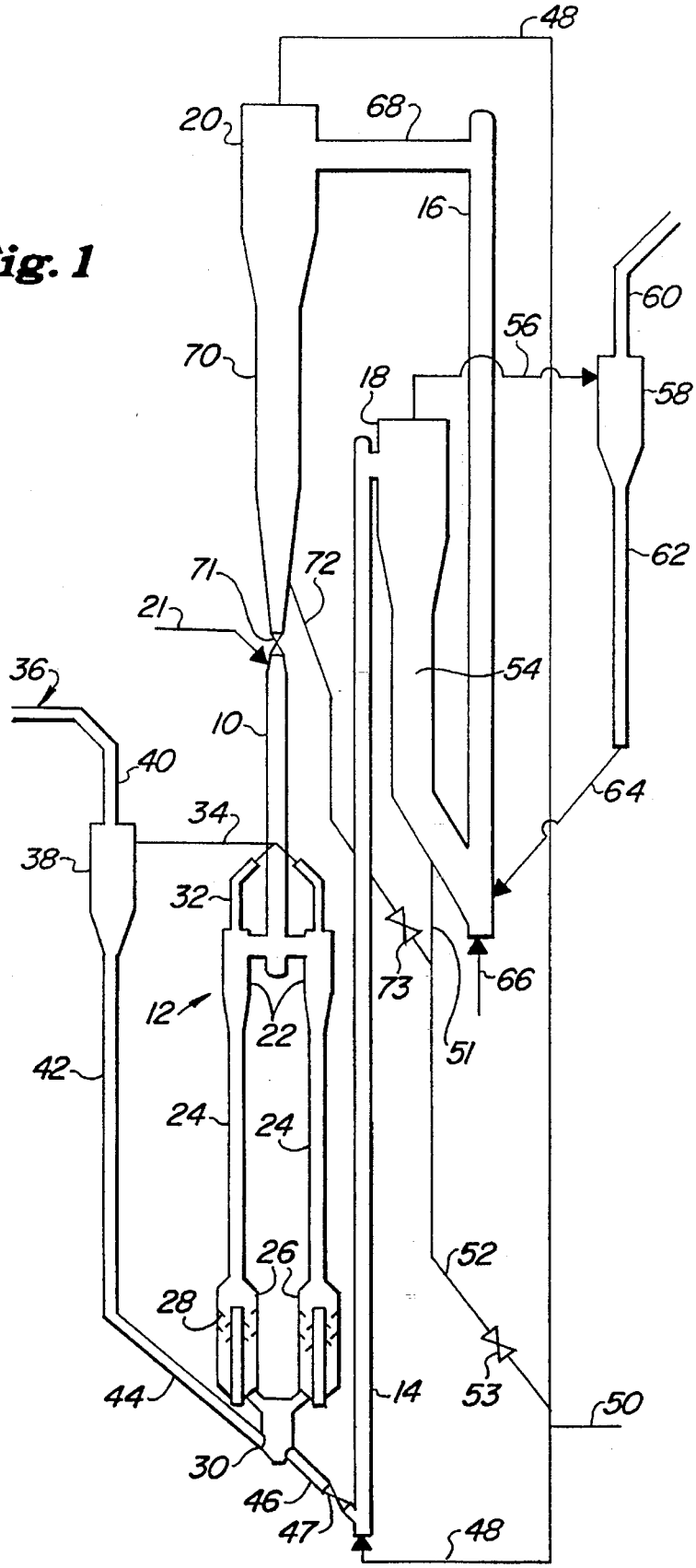
FIG. 1 is a sectional elevation that schematically illustrates the apparatus of this invention.

This invention is more fully explained in the context of an FCC process. The drawing of this invention shows a typical FCC process arrangement. The description of this invention in the context of the specific process arrangement shown is not meant to limit it to the details disclosed therein. The FCC arrangement shown in FIG. 1 consists of a reaction conduit 10, an initial separator 12, a first regenerator riser 12, a second regenerator riser 16, a first regenerator separator 18 and a second regenerator separator 20. The arrangement circulates catalyst and contacts feed in the manner hereinafter described.

The catalyst that enters the reaction conduit can include any of the well-known catalysts that are used in the art of fluidized catalytic cracking. These compositions include amorphous-clay type catalysts which have, for the most part, been replaced by high activity, crystalline alumina silica or zeolite containing catalysts. Zeolite catalysts are preferred over amorphous-type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, alumina, or zirconium. These catalyst compositions may have a zeolite content of 30% or more.

FCC feedstocks, suitable for processing by the method of this invention, include conventional FCC feeds and higher boiling or residual feeds. The most common of the conventional feeds is a vacuum gas oil which is typically a hydrocarbon material having a boiling range of from 650°–1025° F. and is prepared by vacuum fractionation of atmospheric residue. These fractions are generally low in coke precursors and the heavy metals which can deactivate the catalyst. Heavy or residual feeds, i.e., boiling above 930° F. and which have a high metals content, are finding increased usage in FCC units. These residual feeds are characterized by a higher degree of coke deposition on the catalyst when cracked. Both the metals and coke serve to deactivate the catalyst by blocking active sites on the catalysts. Coke can be removed to a desired degree by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst makeup required to maintain constant activity. The contaminant metals include nickel, iron, and vanadium. In general, these metals affect selectivity in the direction of less gasoline and more coke. Due to these deleterious effects, the use of metal management procedures within or before the reaction zone are anticipated in processing heavy feeds by this invention. Metals passivation can also be achieved to some extent by the use of an appropriate lift gas in the upstream portion of the reaction conduit.

Turning again to FIG. 1, feed enters the top of the reaction conduit 10 from a line 21. A flow control valve 71 regulates a flow of catalyst out of a dip pipe conduit 70 into reaction conduit 10. Prior to contact with the catalyst the feed will ordinarily have a temperature in a range of from 300° to 700° F. As the feed and catalyst mixture travels down the reaction conduit, the feed components are cracked and the mixture achieves a constant temperature. This temperature will usually be at least 900° F. and more typically about 1050° F. Conditions within the riser will can include typical riser catalyst densities of less than 30 lbs/ft$^3$ and more typically, less than 10 lbs/ft$^3$, but may also operate with relatively high catalyst densities of 30 to 40 lbs/ft$^3$. The length of the reaction conduit is set to provide a desired residence time for feed contacting which is usually in a range of from 0.1 to 10 seconds and, more typically, in a range from 0.5 to 3 seconds. At the bottom of the conduit 10, product vapors are transferred to the separation zone 12 for the removal of cracked hydrocarbons from the spent catalyst.

FIG. 1 depicts a particular arrangement for the separation zone having a pair of cyclones 22 that directly receive the catalyst and cracked hydrocarbon mixture from reaction conduit 10. The cyclones 22 have extended dip pipe conduits 24 that terminate with an enlarged portion 26 at their lower ends. Enlarged portion 26 provides a stripping zone which supplies means for contacting the spent catalyst from the reaction conduit with a stripping gas which is typically steam. Stripping gas rises countercurrently through the enlarged portions 26 and countercurrently contacts the catalyst through a series of baffles 28 located within the enlarged dip-pipe conduits. A collection chamber 30 receives stripped catalyst particles from the enlarged dip pipe conduits 26. FIG. 1, shows stripping gases and product vapors vented back upwardly through conduits 24 and out with the product vapors that leave the cyclones through outlets 32. Alternatively, product vapors may be vented from enlarged dip conduits 26 to a conduit 34.

Combined vapors collected by conduit 34 may be transferred directly to a separation zone for the removal of gases and heavy hydrocarbons from the products. Such products separation facilities will consist of a main column (not shown) that contains a series of trays for separating heavy components such as slurry oil and heavy cycle oil from the product stream. Lower molecular weight hydrocarbons are recovered from upper zones of the main column and transferred to separation facilities or gas concentration facilities in manner well known to those skilled in the art.

FIG. 1 shows an arrangement wherein immediately after quenching cracked hydrocarbons from conduit 34 enter a second separation zone in the form of a reactor cyclone 38. Where cyclone 38 is provided cracked hydrocarbons having a further reduction in particulate material leave overhead through a conduit 40 for separation in a main column and recovered catalyst particles pass downwardly through a dip pipe 42 and into collection chamber 30 via a conduit 44.

In the preferred embodiment shown in FIG. 1, a quench stream 36 lowers the temperature of the reactants passing through conduit 40. Quench stream 36 may also inject quench medium into conduit 34. Quenching of the cracked hydrocarbons which prevents further uncontrolled and undesired cracking to lighter gases and helps maintain the desired selectivity for the products recovered from the cracked hydrocarbons. In cases where the cracked hydrocarbons stream from conduit 34 is transferred directly to a main column separation zone the quenched stream will ordinarily lower the temperature of the cracked hydrocarbons to less than 900° F. and, more preferably, to less than 850° F. Reductions in the temperature of the cracked hydrocarbons below 850° F. are generally not possible when quenching upstream of a second stage of cyclone separation. Temperatures below 800° F. can cause the condensation of cracked hydrocarbon vapors and interfere with the operation of downstream cyclone and the quenched temperature of the cracked hydrocarbons should remain well above a condensation temperature before entering a cyclone.

A spent catalyst conduit 46 transfers catalyst from the collector to regenerator conduit 14 at a rate regulated by a control valve 47. A hot regeneration gas from a regeneration gas conduit 48 mixes with the spent catalyst and pneumatically conveys the catalyst upwardly through regenerator conduit 14. Regenerator conduit 14 provides a first stage of coke combustion for the spent catalyst. Regeneration gas conduit 48 supplies the necessary oxygen for the combustion of coke. Regeneration gas in conduit 48 is obtained hereinafter described second stage of coke combustion and will usually have a temperature in a range of from 1200° to 1500° F. Regeneration gas passing through conduit 48 will usually have an oxygen concentration in a range of from 2 to 8 mol % and will also contain CO from the previous coke combustion. The high temperature of the first regeneration gas that contacts the catalyst helps to promote rapid combustion of coke. The oxygen concentration of the regeneration gas may be raised by adding air or other oxygen-containing gas to the conduit 48 via a line 50. Residence time through the first regenerator conduit will usually be sufficient to combust a majority of the coke from the catalyst and give the catalyst and gas an average residence time in a range of from 25 to 50. When greater coke combustion is desired in the first regenerator conduit, it is also possible to increase the transfer of heat to the spent catalyst entering riser 14 by mixing hot, fully regenerated catalyst particles from a conduit 52, at a rate regulated by a control valve 53, with the regeneration gas passing through conduit 48.

The first stage of combustion ends by discharge of catalyst particles and the first regeneration gas from an upper end of conduit 14 into first regenerator separator which generally takes the form of cyclone 18. The at least partially regenerated catalyst particles pass downwardly through a dip pipe conduit 54 of cyclone 18. A conduit 51 may take a portion of the catalyst passing down conduit 54 to transfer to regeneration gas conduit 48 via conduit 52. Spent regeneration gas passes overhead from separator 18 and may be removed from the process or under go an additional stage of separation for the recovery of additional fine catalyst particles. As depicted in FIG. 1, a line 56 carries spent regeneration gas from cyclone separator 18 into a second stage of cyclone separation provided by cyclone 58. Fine catalyst particles recovered from cyclone 58 pass downwardly through a dip pipe conduit and over to riser conduit 16 via another conduit 64. Spent regeneration gas passes overhead from cyclone separator 58 through a conduit 60 for possible additional treatment. Such treatments include the removal of ultrafine catalyst particles, heat recovery and the conversion of CO to $CO_2$.

In regard to the conversion CO to $CO_2$, first regenerator conduit 14 will typically operate with only partial combustion of CO to $CO_2$. Therefore, the spent regeneration gas from line 60 will contain carbon monoxide that is usually converted to $CO_2$ in a CO boiler (not shown). The regeneration section of this invention is preferably operated with partial combustion of CO in order to lower regeneration temperature. High regeneration temperatures can have detrimental effects on the catalyst structure and can lower catalytic selectivity by decreasing the catalyst to oil ratio. The process may be operated to obtain complete CO combustion by transferring hot catalyst necessary as necessary from the primary dip pipe conduit 54, or other hot catalyst sources, in order to increase the temperature of the regeneration gas carried by line 48 the addition of sufficient oxygen through line 50 to obtain the complete CO combustion.

Catalyst from dip pipe 54 passes downwardly into the bottom of the second regenerator conduit 16. Regenerated catalyst recovered from the first stage of combustion is mixed with regeneration gas that enters the bottom of conduit 16 via a conduit 66. Conduit 66 will typically provide the primary supply of regeneration gas to the process. This regeneration gas is typically air that enters the process at a temperature of 500° F. or less. The high specific heat of the catalyst contacting the regeneration gas facilitates rapid combustion of any coke remaining on the catalyst from conduit 54 so that the catalyst is completely regenerated. Complete regeneration, generally refers to catalyst having a coke concentration of less than 0.1 wt %.

Both the first and second regenerator conduits will usually operate with a catalyst density of from 2 to 4 lbs/ft$^3$ traveling up the conduits and a velocity in the conduits of from 20 to 70 ft/sec. Gas velocities in the second regeneration conduit will usually be lower than those in the first conduit and will usually be in a range of from 20 to 50 ft/sec. The major portion of the combustion occurs in the first regenerator conduit which will typically have a residence time of from 25 to 50 sec.

A horizontal transfer conduit 68 conveys completely regenerated catalyst particles into the second separator which is in the form of cyclone 20. The outlet of cyclone 20 provides the first regeneration gas carried by line 48. The catalyst particles separated from the first regeneration gas passes downwardly into the enlarged dip pipe 70 which feeds completely regenerated catalyst directly into the top of reaction conduit 10. The regenerated catalyst from conduit 70 usually has a temperature in range of from about 1100° to 1450° F., and preferably a temperature less than 1400° F. The completely regenerated catalyst will usually have a temperature that is higher than the temperature of catalyst in dip pipe conduit 54. The difference in temperature will usually be in a range of from 5° to 100° F. Hotter catalyst from the dip pipe conduit 70 is withdrawn as desired through a conduit 72 at a rate regulated by a control valve 73 as an additional source of hot catalyst for first regeneration gas conduit 48.

This system operates with a very low inventory of catalyst. In order to increase the inventory of catalyst for more flexibility and less sensitivity in operation, it may be desirable to increase the volume of collector 30. The volume of collector 30 may be increased as desired in order to provide a zone for monitoring catalyst level. Catalyst level should also be monitored in dip pipe 70 in order to prevent any flow of oxygen-containing gas into reaction conduit 10.

Figure 2:
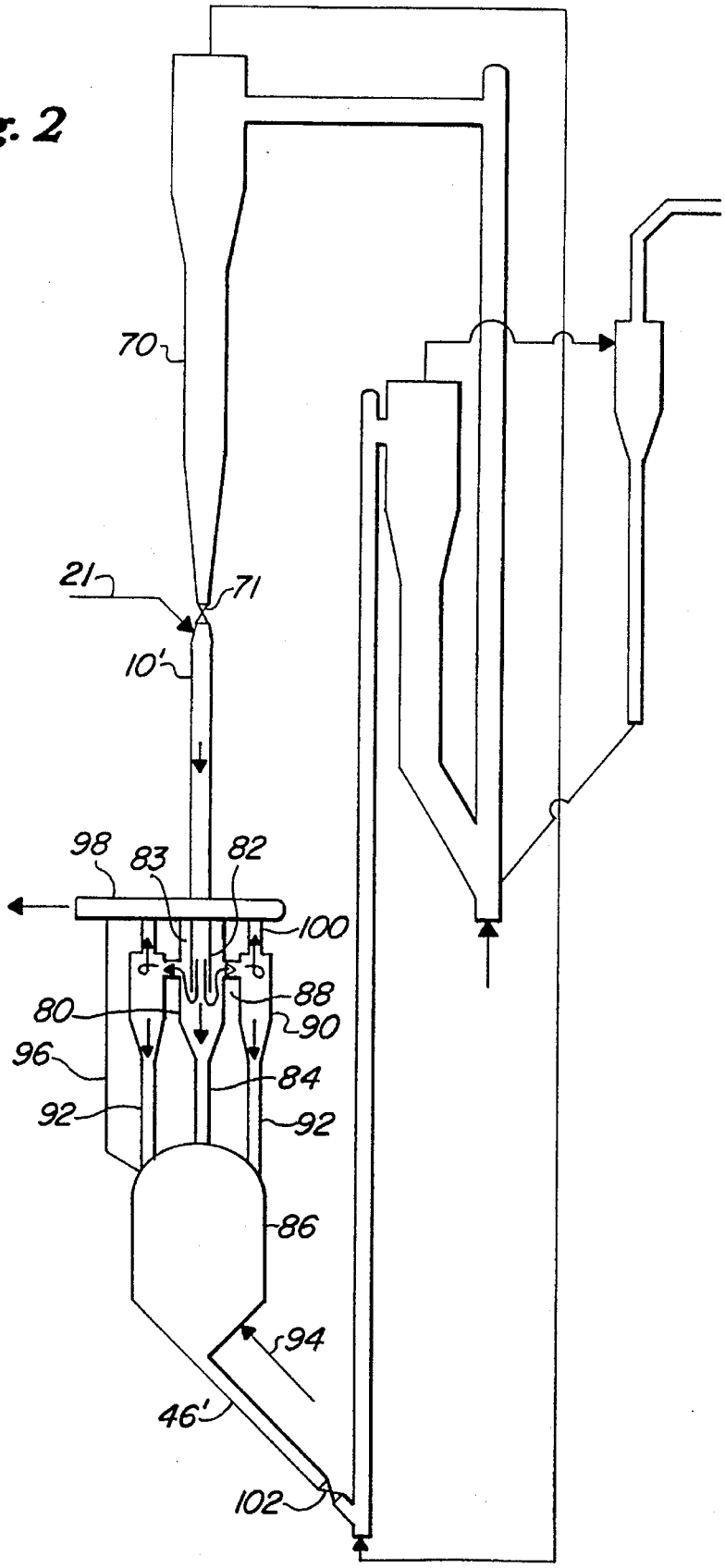
FIG. 2 is a schematic elevation of the apparatus of this invention having a modified arrangement for separating spent catalyst from hydrocarbon vapors.

Separator 12 and collector 30 may be replaced with a combination of ballistic separations and cyclones and a stripping vessel as shown in FIG. 2. In FIG. 2, dip pipe conduit 70 again passes hot, regenerated catalyst having a temperature in a range of from 1100° to 1450° F. to a reaction conduit 10' wherein feed from a conduit 20 contacts catalyst in the manner previously described. A small diameter containment vessel 80 surrounds an outlet end 82 of reaction conduit 10'. Outlet end 82 downwardly discharges spent catalyst particles and cracked hydrocarbons. Containment vessel 80 together with riser outlet end 82 defines annular collection volume 83 that communicates with cyclone inlets 88. The cracked hydrocarbons, having a much lower density than the catalyst particles, change direction quickly in the well-known manner of a ballistic separation and enter inlets 88 of cyclone separators 90. The spent catalyst particles continue on their downward trajectory to the bottom of containment vessel 80 and empty via a conduit 84 into a stripping vessel 86.

Additional spent catalyst particles separated by cyclone separators 90 empty into stripping vessel 86 via dip pipe conduits 92. A line 94 delivers stripping gas into stripping vessel 86 in an amount that is typically equal to 0.05 to 0.3 wt % of the catalyst particles entering vessel 86. Baffles or other structures may be added inside vessel 86 to increase the contacting between the catalyst particles and the stripping gas within vessel 86. The stripping gas rises countercurrently and is either withdrawn from the stripping vessel by rising countercurrently through any of dip pipes 84 or 92 or, alternately, may be withdrawn from vessel 86 via a separate conduit 96. A manifold pipe 98 collects cracked hydrocarbons from cyclones 90 via outlet conduits 100. Manifold 98 also collects stripping gas from a conduit 96, when provided. Cracked hydrocarbons and product vapors are removed from manifold 98 for further separation in the manner previously described. Stripped hydrocarbons flow out of the stripping vessel 86 through a spent catalyst conduit 46' at a rate regulated by a flow control valve 102.

Flow control valve 102 may be operated in response to a catalyst flow level in dip pipe 70 with a small catalyst inventory maintained in vessel 86 in order to insure that a sufficient catalyst level remains in cyclone dip pipe 70. By using control valve 102 as a secondary level control means for dip pipe conduits 70, flow control valve 71 may be kept at a constant opening in order to supply a consistent quantity of catalyst to reaction conduit 10'.

Figure 2A:
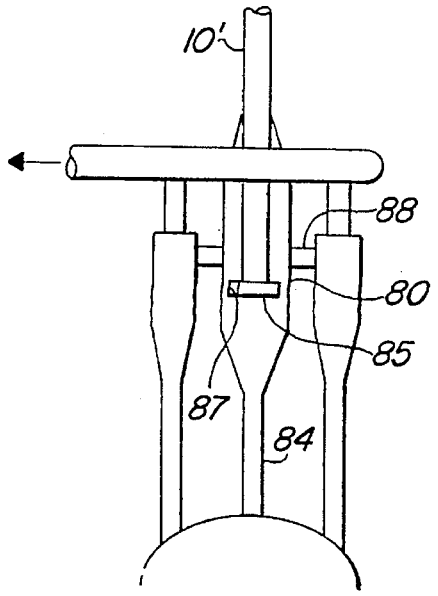
FIG. 2A is a modified sectional elevation of a portion of the apparatus of FIG. 2.

Initial separation between the catalyst and the cracked hydrocarbons at the end of reaction conduit 10' may be effected by projecting the solids downward and disengaging the gas in an upward direction. Depending on the flow regime and disengaging length from the bottom of the reaction conduit 10' and the catalyst bed height in conduit 84, separation may be improved by imparting a tangential velocity to the catalyst and gas mixture as it exits the end of the reaction conduit 10'. FIG. 2A show the end of the riser modified to add a tangential separation device 85. Separation device 85 discharges the catalyst and gas mixture tangentially through a pair of openings 87 that initiate a downward spiral movement of the catalyst that disengages the cracked hydrocarbons. Separated catalyst particles flow downwardly out of containment vessel 80 via a conduit 84. Cracked hydrocarbons are again exit the containment vessel 80 through cyclone inlets 88. Methods and devices for using a tangential velocity for the separation of cracked hydrocarbons are known to those skilled in the art and disclosed in U.S. Pat. No. 4,482,451, the contents of which are hereby incorporated by reference.

Figure 3:
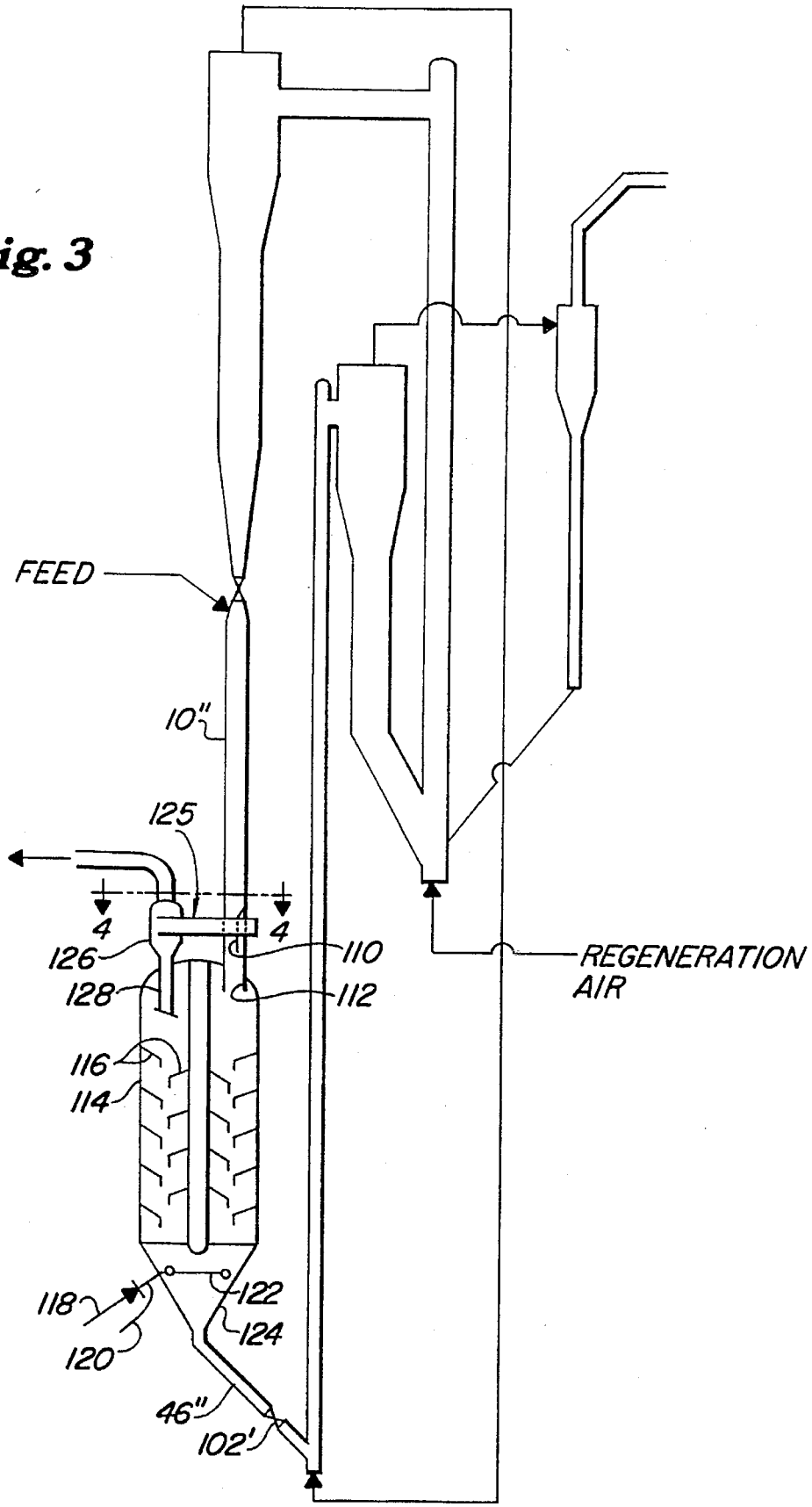
FIG. 3 is another sectional elevation of this invention having a further modification of the apparatus for the separation of spent catalyst from reactor vapors.

FIG. 3 shows an alternate arrangement for an initial separation and stripping zone at the end of a reaction conduit 10". This arrangement eliminates the containment vessel 80 shown in FIG. 2. In this arrangement, the mixture of spent catalyst and cracked hydrocarbons flows downwardly past a baffle 110 that sectors off a portion of reaction conduit 10" near an outlet end 112. Again, in the well-known manner of ballistic separation, spent catalyst particles having a higher momentum flow out of outlet 112 and continue into the interior of a stripping vessel 114. Stripping vessel 114 has a plurality of downwardly sloped annular baffles 116 arranged in the traditional manner of an FCC stripper. Stripping gas supplied by a line 118 enters the bottom of stripping vessel 114 through an inlet 120 that supplies the stripping gas to a distributor 122. Stripping gas flows upwardly from distributor 122 countercurrently to the downward flow of spent catalyst particles. The countercurrent flow strips additional hydrocarbons from the spent catalyst particles which collect in a bottom cone 124 of the stripping vessel and are delivered via a conduit 46" at a rate regulated by a control valve 102'. The delivery of catalyst and the operation of the stripping vessel in regard to catalyst levels is the same as that described previously in conjunction with FIG. 2. Stripping gas and cracked hydrocarbons flow from the area sectored by baffle 110 into a manifold pipe 125. Manifold pipe 125 delivers stripping gas and recovered hydrocarbons from the stripping vessel as well as cracked hydrocarbons and entrained catalyst particles to a cyclone 126. Cyclone 126 returns additional entrained catalyst particles to stripping vessel 114 via a dip pipe conduit 128.

Figure 4:
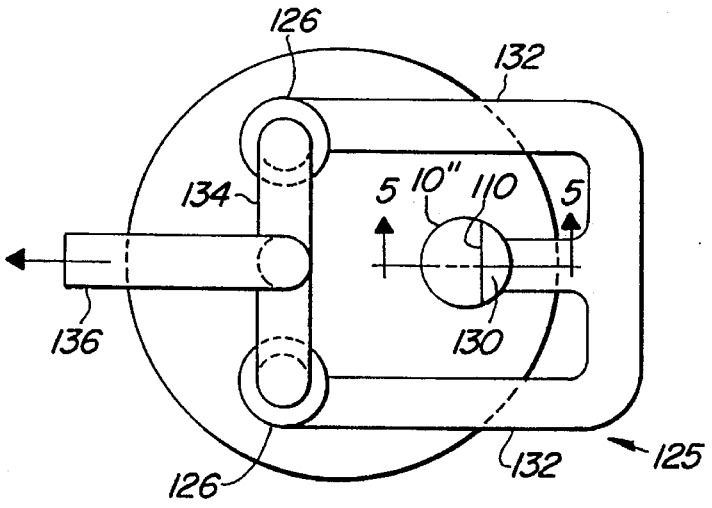
FIG. 4 and 5 are enlarged details of the modified section shown in FIG. 3.

The arrangement of baffle 110 manifold pipe 125 and cyclones 126 is more fully illustrated in FIG. 4. Looking then at FIG. 4, baffle 110 partitions off a sector 130 of conduit 110 to form a collection zone that preferentially collects lighter gases as opposed to heavier and higher momentum catalyst particles. The gases and some catalyst particles flow from collection space 130 into the manifold arrangement 125 having dual ducts 132 that communicate the gases and catalyst particles to the inlets of cyclones 126. An outlet manifold 134 collects cracked hydrocarbons and stripping gas from the outlets of cyclone 126 into a common conduit 136 that delivers the cracked hydrocarbons and stripping gas for further separation as previously described.

Figure 5:
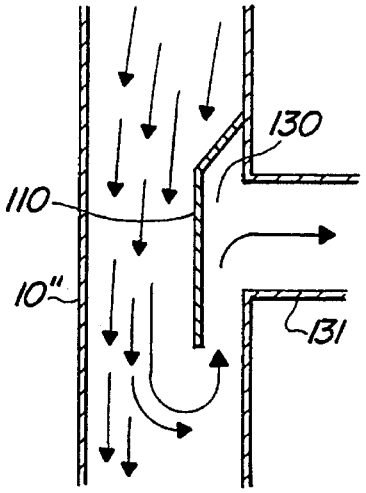

The use of baffle 110 to sector a collection space 130 may in many cases increase the efficiency of the separation between the catalyst particles and the cracked hydrocarbon vapors. As better illustrated by FIG. 5, the flow obstruction created by baffle 110 tends to direct the high momentum catalyst particles toward a portion of the wall of conduit 10" that is opposite baffle 130. Imparting momentum to the higher density catalyst particles in a direction away from baffle 30 further segregates the catalyst particles from the lower density gases. As a result, less catalyst particles are drawn in with the gases that exit conduit 10" through an outlet 131. It may be possible to further enhance this separation achieved by the initial separation arrangement depicted in FIGS. 3, 4 and 5 by adding a small bend or elbow immediately up stream of baffle 130 in the path of conduit 110".

What is claimed:

1. An apparatus for the catalytic cracking of hydrocarbons, said apparatus comprising:

a) vertical reaction conduit defining an upper inlet for receiving catalyst particles and mean for introducing hydrocarbons into an upper portion of said conduit;

b) separator in communication a lower end of said conduit for separating gas from spent catalyst particles;

c) means for contacting catalyst particles from said reaction conduit with a stripping gas;

d) a catalyst collector communicating with a spent catalyst conduit to transfer spent catalyst from said collector to said spent catalyst conduit;

e) a first regenerator riser in communication at its lower end with a said spent catalyst conduit and a first regeneration gas conduit to transfer spent catalyst particles upwardly to the top of said riser;

f) a first regenerator cyclone communicating with an upper end of said first regenerator riser to separate said first regeneration gas from catalyst particles;

g) a second regenerator riser having a lower end in communication with said first regenerator cyclone for receiving catalyst particles therefrom and having means for contacting catalyst particles with a first regeneration gas to transport said catalyst particles upwardly therein;

h) a second regenerator cyclone located above said reaction conduit having an inlet in communication with an upper end of said second regenerator riser, a gas outlet communicating with said first regeneration gas conduit, and a primary dip pipe conduit in direct communication with said reaction conduit for directly transferring regenerated catalyst particles to the inlet of said reaction conduit.

2. The apparatus of claim 1 wherein said separator comprises a first reactor cyclone having a stripping dip leg comprising an enlarged conduit containing a series of baffles therein that at least partially supplies said means for contacting catalyst particles from said reaction conduit with a stripping gas.

3. The apparatus of claim 2 wherein said first reactor cyclone has an outlet that communicates with an inlet of a second reactor cyclone and an outlet conduit of said second reactor cyclone communicates with a said catalyst collector to transfer recovered catalyst thereto.

4. The apparatus of claim 1 wherein a hot catalyst conduit communicates catalyst from said first regenerator cyclone to said first regeneration gas conduit.

5. The apparatus of claim 4 wherein said apparatus has means for introducing a fresh regeneration gas into said first regeneration gas conduit.

6. The apparatus of claim 1 wherein said first regenerator cyclone has a gas outlet that communicates with the inlet of a third regenerator cyclone and said third regenerator cyclone has an catalyst outlet in communication with said second regenerator riser for communicating catalyst from said third regenerator cyclone to said second regenerator riser.

7. The apparatus of Claim 1 wherein said collector comprises a stripping vessel and at least partially provides said means for contacting catalyst with a stripping gas.

* * * * *

UNITED STATES PATENT AND TRADEMARK OFFICE
CERTIFICATE OF CORRECTION

PATENT NO: 5,589,139
DATED: December 31, 1996
INVENTORS: RANDY J. ZINKE and William J. Koves

It is certified that error appears in the above-identified patent and that said Letters Patent is hereby corrected as shown below:

In column 9, line 50, change "mean" to - - means - -.

Signed and Sealed this

Fourth Day of March, 1997

*Attest:*

*Attesting Officer*

BRUCE LEHMAN

*Commissioner of Patents and Trademarks*